United States Patent [19]

Pozniak et al.

[11] 4,223,648

[45] Sep. 23, 1980

[54] HYDRAULIC VALVE LIFTER

[75] Inventors: Donald J. Pozniak, Utica; Ronald J. Herrin, Clawson, both of Mich.

[73] Assignee: General Motors Corporation, Detroit, Mich.

[21] Appl. No.: 965,281

[22] Filed: Dec. 1, 1978

[51] Int. Cl.[3] ..... F01L 1/34

[52] U.S. Cl. ..... 123/90.16; 123/90.55

[58] Field of Search ..... 123/90.16, 90.15, 90.55, 123/90.56, 90.57, 90.58, 90.59

[56] References Cited

U.S. PATENT DOCUMENTS 3,509,858 5/1970 Scheibe et al. ..... 123/90.55 X

*Primary Examiner*—Harry N. Haroian

*Attorney, Agent, or Firm*—Arthur N. Krein

[57] ABSTRACT

A hydraulic valve lifter for an internal combustion engine is provided with a thin flexible valve disc, with a sharp edge orifice therethrough, that is operative to sense the oil flow rate between a hydraulic supply chamber and a pressure chamber within the lifter whereby to regulate the volume capacity of the pressure chamber and therefore the axial extent of the valve lifter as a function of engine speed.

4 Claims, 7 Drawing Figures

HYDRAULIC VALVE LIFTER

FIELD OF THE INVENTION

This invention relates to internal combustion engines and, in particular, to hydraulic valve lifters for use in obtaining variable valve overlap in such engines.

Specifically, the invention relates to hydraulic valve lifters that are operative for varying the valve timing and the intake and exhaust valve overlap in an internal combustion engine.

BACKGROUND OF THE INVENTION

Various mechanisms are known in the prior art for use in obtaining variable valve timing and variable valve overlap in an engine whereby to obtain the different advantages obtainable from such varying of valve timing and valve overlap as a function of engine operation.

In United States Pat. No. 4,054,109, entitled "Engine with Variable Valve Overlap" issued to Applicants on Oct. 18, 1977, there is disclosed a variably yieldable load-carrying member or hydraulic valve lifter used in the actuating mechanism of one or both of the intake and exhaust valves of each cylinder of an associated engine.

Although hydraulic valve lifters of the type disclosed in the above-identified U.S. Pat. No. 4,054,109 have been used in engines wherein they were operative to provide the desired function of varying the engine valve opening duration as a function of engine speed, it has now been found that such lifters are not only viscosity sensitive but, at engine speeds above 2200 rpm, in such lifters the amount of lifter collapse would not decrease with increased engine speeds.

Accordingly, it is a primary object of the present invention to provide an improved hydraulic valve lifter for use in an internal combustion engine and which lifter is operative to vary the lift and timing of a cam actuated valve as a function of engine speed, the lifter not being sensitive to changes in the viscosity of oil supplied thereto.

Another object of the present invention is to provide an improved hydraulic valve lifter wherein a thin sharp edge orifice valve disc is used to sense oil flow rate between a hydraulic supply chamber and a pressure chamber within the lifter whereby to regulate, in effect, the volume capacity of the pressure chamber as a function of engine speed essentially independent of oil viscosity.

Still further object of the present invention is to provide an improved hydraulic valve lifter of the above type which is provided with an increased flow area for the flow of oil from the hydraulic supply chamber to the pressure chamber of the lifter whereby the pressure chamber can be filled with oil more readily at high engine speeds.

For a better understanding of the invention, as well as other objects and further features thereof, reference is had to the following detailed description of the invention to be read in connection with the accompanying drawings, wherein.

DESCRIPTION OF THE FIRST EMBODIMENT

Figure 1:
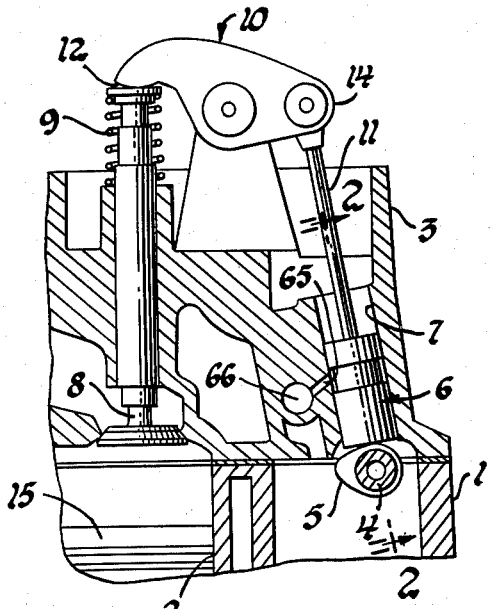
FIG. 1 is a fragmentary cross-sectional view of an internal combustion engine showing the valve train for one valve of a cylinder of the engine, the valve train having a hydraulic valve lifter in accordance with the invention incorporated therein.

Referring first to FIG. 1 there is shown a portion of an otherwise conventional engine which includes a cylinder block and crank case 1 in which one of more cylinders 2 are provided and which are closed at their upper ends by a cylinder head 3. Suitably journaled in the crank case is a camshaft 4 with a cam 5 thereon which operatively engages a tappet in the form of a hydraulic valve lifter 6, in accordance with the invention, so as to cause it to reciprocate in a suitable bore 7 provided for this purpose as in the cylinder head 3. An engine poppett valve 8, reciprocably mounted in the cylinder head and biased to its closed position by a valve return spring 9 in conventional manner, is operatively connected to the hydraulic valve lifter 6 by a valve rocker 10 and a hollow push-rod 11.

The particular valve rocker 10, illustrated in the construction shown, is pivotly supported intermediate its ends on the cylinder head 3 whereby one end 12 thereof is in bearing engagement with the upper end of the poppet valve 8 while its opposite end 14 is operatively connected to the push rod 11 whereby reciprocating movement of the push rod 11 will effect corresponding movement of the poppet valve 8. The poppet valve 8 can either be the intake valve or the exhaust valve for the cylinder 2 shown since the valve train arrangement for either valve would be of similar construction. As is well-known, the camshaft 4 would be connected to the engine crankshaft, not shown, for rotation in timed relation with the reciprocating motion of the piston 15 reciprocally journaled in the cylinder 2 and which would be operatively connected to the camshaft. Except for the tappet or hydraulic valve lifter to be subsequently described, these elements are of or are intended to represent conventional constructions which may be found in various forms in automotive vehicle engines.

Figure 2:
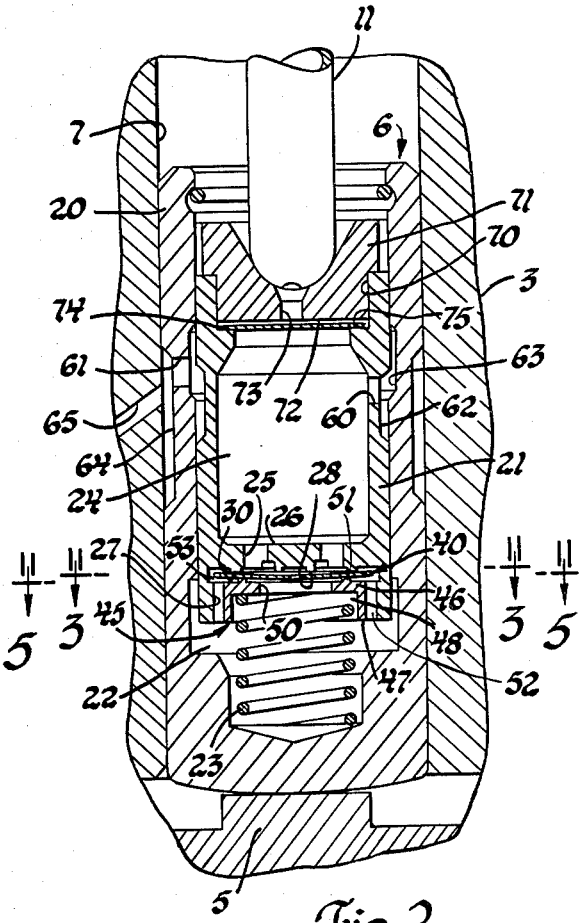
FIG. 2 is a cross-sectional view, taken generally in the plane of the line 2—2 of FIG. 1 and illustrating the internal construction of a first embodiment of a hydraulic valve lifter in accordance with the invention.
Figure 3:
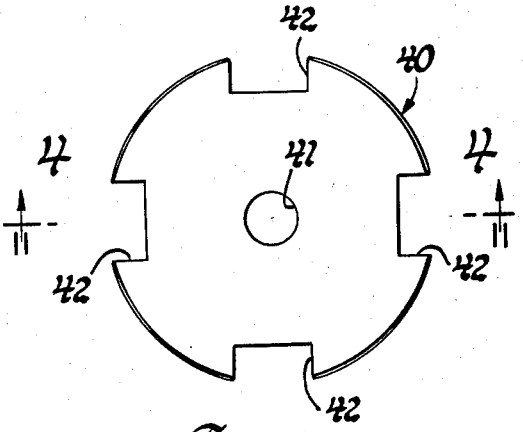
FIG. 3 is a view taken along line 3—3 of FIG. 2 showing the sharp edge orifice valve disc of the lifter assembly of FIG. 2.

Referring now to the subject manner of the present invention, the hydraulic valve lifter 6, in the construction of the first embodiment shown in FIG. 2, includes a cup-shaped cylinder member 20 having a nesting cup-shaped plunger member 21 telescopically slidable therein and defining a pressure chamber 22 between their respective closed ends. Within the pressure chamber 22 and biasing the plunger member outwardly of the cylinder member 20 is a spring 23 of predetermined force. The interior of the plunger member 21 forms an oil reservoir chamber 24 for supplying oil to the pressure chamber 22.

Now in accordance with the invention, fluid communication between the reservoir chamber 24 and the pressure chamber 22 is effected by four equally spaced apart axial extending ports 25 in the end wall 26 of the plunger member 21, only two such ports 25 being shown in FIG. 2. Flow through these ports 25 is controlled by a thin, sharp edge, orifice valve disc 40 to be described in detail hereinafter.

In the construction shown in FIG. 2, the plunger member 21 is provided with a blind bore extending from its lower end to terminate at the end wall 26. The blind bore thus defining an annular circular inner wall 27 which extends from the lower end of the plunger member 21 to terminate at the end wall 26 which is spaced a predetermined axial distance from the lower end of the plunger member. The end wall 26 on its lower face is provided with concentric, depending annular inner and outer ribs located radially inward and outward, respectively, of the ports 25, these ribs terminating in co-planar inner and outer valve seats 28 and 30, respectively.

Figure 4:
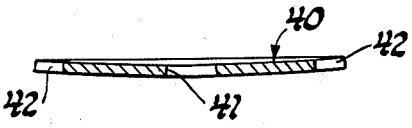
FIG. 4 is a cross-sectional view of the sharp edge orifice disc valve of FIG. 3 taken along line 4—4 of FIG. 3.

Referring now to the valve disc 40, this valve disc is in the form of a thin Belleville spring disc which is provided with a central orifice 41, of a predetermined diameter, a diameter which is less than the diameter of the valve seat 28 for a purpose which will become apparent. In the particular construction shown, the valve disc 40 is of substantially circular configuration and of a predetermined diameter so as to be loosely received within inner wall 27 of plunger member 21, but it is provided with four recessed notches 42. Each notch 42 extend radially inward from the outer peripheral edge of the valve disc and these notches 42 are circumferentially spaced apart relative to each other. The valve disc 40, as thus formed in the shape of a Belleville spring, has its central part bent downward, with reference to FIGS. 2 and 4, and, it is thus assembled into the lifter plunger member 21. As thus positioned, its outer upper surface radially outward of orifice 41 is adapted to abut against the valve seat 30, while its radially inward portion next adjacent to the orifice 41 would normally be spaced axially downward relative to the valve seat 28, for a purpose to be described, when it is in abutment against valve seat 30.

Figure 5:
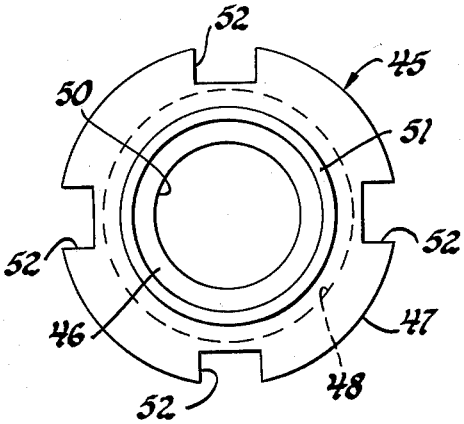
FIG. 5 is a view taken along line 5—5 of FIG. 2 showing the valve disc retainer, per se, of the hydraulic valve lifter of FIG. 2.

The valve disc 40 is axially positioned and retained in the plunger member 21 by means of a valve disc retainer 45. Valve disc retainer 45, as best seen in FIGS. 2 and 5, is of substantially cylindrical configuration and of a diameter relative to inner wall 27 whereby to be slidably received in the cavity provided thereby. The valve disc retainer includes a base 46 from which an annular flange 47 depends whereby to define with the base a central spring cavity 48 which is adapted to receive the upper end of the spring 23. The base 46 of the valve disc retainer 45 is provided with a central bore passage 50, of predetermined diameter, which opens into the spring cavity 48. In addition, the base 46 is provided with an upright annular rib located radially outward of and concentric to the bore passage 50, this rib terminating at its upper end in a valve seat 51. The valve disc retainer 45 is also provided with four, circumferentially equally spaced apart, slots 52 adjacent to its outer periphery which extend the full axial length of the flange 47 thereof.

As seen in FIG. 2, the valve disc retainer 45 is slidably positioned in the lower end of the plunger member 21 and is normally biased upward toward the end wall 26 of the plunger member whereby its valve seat 51 is axially movably positioned to abut against the lower domed surface of the valve disc 40 whereby the valve seat 51 is positioned in axial spaced relation from the valve seats 28 and 30 so as to provide a variable volume valve chamber 53 of a suitable axial extent between the upper surface of the disc retainer 45 and the end wall 26 in which the valve disc 40 is loosely positioned. As thus loosely positioned within the valve chamber 53, the valve disc 40 is free for axial movement between the valve seats 28 and 30 and the valve seat 51 of the valve disc retainer 45 as the latter moves axially within the plunger member 21 in a manner and for a purpose to be described. With the valve disc retainer 45 thus assembled into the cylinder member 21, each of the slots 52 of the valve disc retainer 45 defines with an associated adjacent portion of wall 27 an axial flow passage to provide for flow communication between the valve chamber 53 and the pressure chamber 22.

The operation of the hydraulic valve lifter thus far described is as follows. When the engine is operating, rotation of the camshaft 4 causes the cam 5 to effect periodic reciprocating movement of the cylinder member 20 through a predetermined lift curve defined by the shape of the cam 5. It will be realized that although only one cam 5 has been shown, both the inlet and exhaust valve for each cylinder of the engine would have their own associated cam and that the shape of the cams for the inlet and exhaust valves may differ as to their opening extent and valve opening period, as well-known in the art.

Now assuming that the foot of the cylinder member 20 is riding on the fall of the cam 5 and the valve 8 is then being permitted to close. When cylinder member 20 then rides on the base circle of the cam 5, the spring 23 will then force the plunger member 21 upward relative to the cylinder member 20 whereby to increase the effective axial extent of these lifter elements so as to maintain zero valve clearance in the components of the valve train. As this occurs, the differential pressure then existing across the valve disc 40 due to engine oil pressure in the reservoir chamber can be such as to cause this valve disc 40 to move downward, with reference to FIG. 2, out of seating engagement with the outer valve seat 30 and into seating engagement with the valve seat 51 and, at the same time causing the valve disc retainer 45 to move relative to the plunger member 21 away from end wall 26 against the bias of spring 23. Oil from the reservoir chamber 24 can then flow via the ports 25 into the valve chamber 53 to then flow downward through orifice 41 and bore passage 50 into the pressure chamber 22.

In accordance with one feature of the invention, oil flowing into the valve chamber 53 via the ports 25 is also now free to flow radially outward through the space provided at this time between the outer valve seat 30 and the upper surface of the valve disc 40 due to the movement of the valve disc retainer 45 relative to the plunger member and then to flow via the unrestricted passages provided by the slots 42 and the passages defined in part by the slots 52 directly into the pressure chamber 23, whereby this chamber can then be rapidly filled with oil even at high engine speeds whereby to insure zero valve clearance even at high engine speeds.

Thereafter, upon further rotation of the cam 5, the foot of the cylinder member 20 will begin to ride on the rise portion of the cam 5. This will cause the cylinder member 20 to move upward, with reference to FIGS. 1 and 2 and, at the same time the plunger member 21 is, in effect, moved downward relative to the cylinder member 20 against the bias of spring 23 whereby to reduce the effective axial extent of these lifter elements. As this occurs, the volume capacity of the pressure chamber is decreased and oil therein is pressurized to a pressure greater than the pressure of the oil in the reservoir chamber 24. This differential pressure across the valve disc 40 will cause the valve disc 40 to be moved upward so that its upper surface will again seat against the outer valve seat 30 whereby to block flow therebetween.

At this time, the increased pressure of fluid in the pressure chamber 22 together with the bias of spring 23 will cause the valve disc retainer 45 to move upward relative to the end wall 26 of the plunger member 21, to the position shown in FIG. 2, whereby engagement is effected between the valve seat 51 and the lower surface of the valve disc 40 radially outboard of orifice 41 therein.

At this time, the Belleville spring shape of the valve disc 40 will still allow oil to escape from the pressure chamber 22 via spring chamber 48, bore passage 50 and out through orifice 41 at a controlled rate so that this oil can then flow via ports 25 back into the reservoir chamber 24. However, as a sufficient differential pressure is established across the valve disc 40, due to the restricted rate of flow through the orifice 41, this differential pressure will cause the Belleville spring shaped valve disc 40 to be bent or flexed upward into a substantially flat shape so that its upper surface will then also engage the inner valve seat 28 to thereby block flow from the orifice passage 41 to the ports 25.

With the valve disc 40 thus seated to prevent further fluid flow from the pressure chamber 22 to the reservoir chamber 24, a controlled amount of oil leakage will still occur between the internal diameter of the cylinder member 20 and the external diameter of the plunger member 21. This oil leakage will then allow a small relative movement of the plunger member 21 in the cylinder member 20. This action, which continues until the lifter returns to the cam base circle of the cam 5, is termed lifter "leak-down", as well-known in the art.

Although a major portion of leak-down oil escaping around the plunger member during the lift stroke reenters the reservoir chamber 24 through the plunger oil inlet port 60 provided for this purpose in the plunger member 21, in order to insure that the reservoir chamber 24 is maintained full of oil at all times, one or more oil inlet openings or ports 61 are provided in the side wall of the cylinder member 20 to communicate with the plunger port 60, via annular recessed grooves 62 and 63 provided on the outer peripheral of the plunger member 21 and the inner peripheral surface of the cylinder member 20, respectively. The port 61, in turn, is continuously supplied with oil via another annular recessed groove 64 on the outer peripheral of the cylinder member 20 from the engine lubricating system, the groove 64 registering with a passage 65 extending from the engine oil gallery 66 in the cylinder head 3.

Above the reservoir chamber 24 the internal side wall of the plunger member 21 is counter-bored from its upper open end to form an enlargement 70 in which is slidably fitted a push-rod seat 71 which is flanged adjacent to its upper end so as to rest on the open upper end of the plunger member. The lower end of the push-rod seat 71 forms a valve seat wall 72 that defines the upper limits of the reservoir chamber 24. The push-rod seat 71 is provided with a central aperture passage 73 extending axially therethrough to provide an outlet from the reservoir chamber 24 in flow communication with the lower open end of the push rod 11. The reservoir chamber face of the wall 72 forms a seat for a generally plate-like valve 74 which is adapted to abut there against for restricting oil flow into the lower open end of the push rod 11 via the aperture passage 73. The shoulder 75 defining the bottom of the counter-bore in the plunger member 21 provides a stop for this value 74 to limit its movement inwardly of the plunger member away from its seating face on wall 72. The valve 74 thus far described is similar in construction and function to that of the hydraulic valve lifter disclosed in U.S. Pat. No. 2,818,050, entitled "Lubricating System" issued Dec. 31, 1957 to Loren R. Papenguth, the disclosure of which is incorporated herein by reference thereto.

Figure 6:
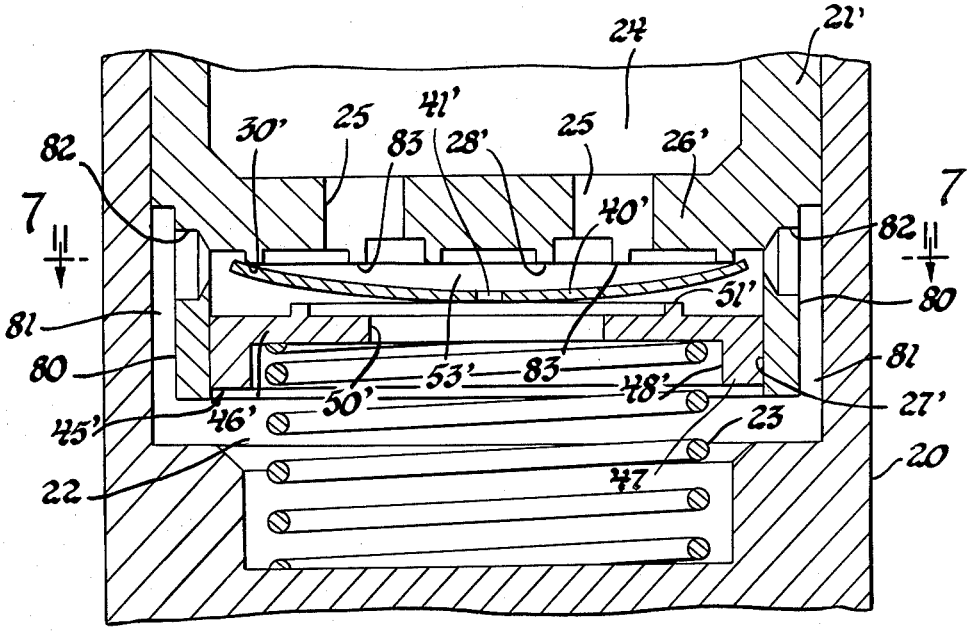
FIG. 6 is a cross-sectional view of the lower portion of an alternate preferred embodiment of a hydraulic valve lifter in accordance with the invention; and, FIG. 7 is a view taken along line 7—7 of FIG. 6 to show the circular valve disc and lower cooperating portions of the plunger member of the hydraulic valve lifter of FIG. 6.
Figure 7:
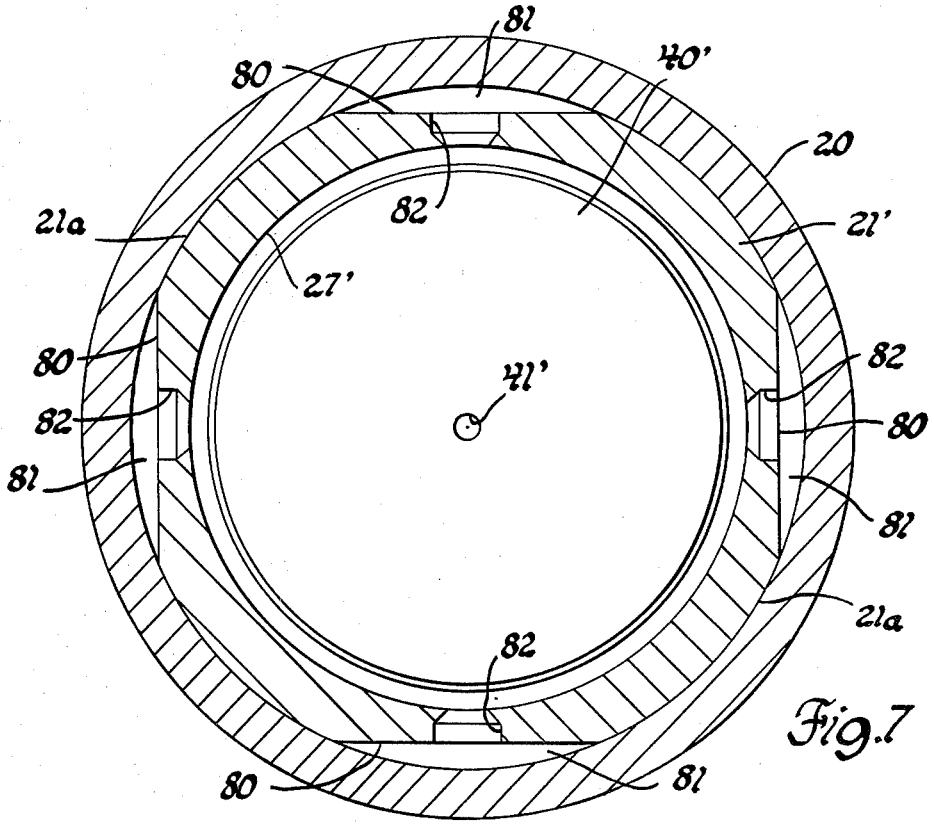

An alternate, preferred embodiment of an orifice valve disc, plunger member and valve disc retainer arrangement for a hydraulic valve lifter in accordance with the invention is shown in FIGS. 6 and 7, wherein similar parts are designated by similar numerals but with the addition of a prime (') after the reference numbers, where appropriate.

In this preferred embodiment, the plunger member 21' of the valve lifter assembly is provided with an axial blind bore which extends from its lower end to terminate at an end wall 26' to define a circular inner wall 27'. The end wall 26' of the plunger member 21' is provided with four circumferentially spaced apart axial ports 25 therethrough.

In addition, this lower end of the plunger member 21' is provided with a plurality of machined flats 80 on the exterior thereof, four such flats 80 being provided in the construction shown, as best seen in FIG. 7. As shown in FIG. 6, each flat 80 extends axially from the lower end of the plunger member 21' to terminate closely adjacent to the horizontal plane of end wall 26' whereby to form with the next adjacent cooperating inner wall surface of the cylinder member 20 an axial passage 81 that opens at its lower end into the pressure chamber 22 of the hydraulic valve lifter. Furthermore, each flat 80, as shown in FIG. 7, is interconnected at a corner thereof to its next adjacent flat by an outer peripheral circular corner surface that is an axial extension of the main body portion of the plunger member 21' whereby to provide guide bearing surface **21*a'* for sliding engagement with the inner peripheral surface of the cylinder member 20. Plunger member 21 in this preferred embodiment is also provided with a plurality of radial side port passages 82. Each such side port passage 82 extends from its flat 80 to breakout through the inner wall 27' whereby to interconnect the pressure chamber 22 via a cooperating passage 81 to the valve chamber 53'**.

As best seen in FIG. 6, the end wall 26' on its lower face is provided with concentric depending inner and outer ribs located radially inward and outward, respectively, of the ports 25 with these ribs thus terminating in co-planar inner and outer valve seats 28' and 30', respectively. This end wall 26' is also provided with a third depending rib that is located concentric with and intermediate the above-described ribs whereby to provide a plurality of semi-circular support lands 83 that are coplanar with the valve seats 28' and 30', for a purpose to be described.

With the arrangement thus far described the Belleville type valve disc 40', used in this preferred embodiment, can be of circular configuration, as best seen in FIG. 7. Thus in this preferred embodiment the valve disc 40′ is only provided with a central orifice 41′ therethrough of predetermined size.

The valve disc 40′ is axially positioned and retained in the plunger member 21′ by means of the valve disc retainer 45′. Valve disc retainer 45′ in this embodiment is of cylindrical configuration with an outside diameter whereby it can be slidably received within the inner wall 27′ of the plunger member 21′.

The valve disc retainer 45′, similar in construction to the valve disc retainer 45 includes a base 46′ from which an annular flange 47 depends whereby to define with the base 46′ a central spring cavity 48′ which is adapted to receive the upper end of the spring 23. Base 46′ of the valve disc retainer 45′ is provided with a central bore passage 50′, of a predetermined diameter substantially greater than that of the orifice 41′ of the valve disc 40′. The bore passage 50′ permits flow communication between the valve chamber 53′ and the pressure chamber 22 via the spring cavity 48′ as controlled by the valve disc 40′ in a manner previously described. Base 46′ of the valve disc retainer 45′ is also provided with an upright annular rib located radially outward of the bore passage 50′ with this rib terminating at its upper end in a valve seat 51′.

In the manner previously described the valve disc retainer 45′ is slidably mounted in the lower end of the plunger member 21′ whereby its valve seat 51′ is axially movable relative to the valve seats 28′ and 30′ on the end wall 26′ of the plunger member 21′ whereby to define a variable volume valve chamber 53′ between the upper surface of the valve disc retainer 45′ and the end wall 26′. As best seen in FIG. 6, the valve disc 40′ is loosely positioned within the valve chamber 53′ for axial movement between the valve seats 28′ and 30′ on end wall 26′ and the valve seat 51′ on base 46′ of the valve seat retainer 45′ upon downward axial movement of the valve seat retainer 45′ relative to the plunger member 21′ end wall 26′ during engine operation in the manner previously described.

The operation of the hydraulic valve lifter, in accordance with the preferred embodiment shown in FIGS. 6 and 7, is similar to that described above in regard to the embodiment of the hydraulic valve lifter shown in FIGS. 2 through 5, except that in the preferred embodiment, as the cylinder member 20 of this unit is riding on the base circle of cam 5, rapid makeup of fluid to the pressure chamber 22 will result due to the free flow of oil from the valve chamber 53′ by the side port passages 82 and their associated axial passages 81 into the pressure chamber 22.

As previously described, the Belleville type valve disc 40′, like the valve disc 40, is designed to snap flat due to the differential pressure thereacross during the lift cycle of the hydraulic valve lifter as pressure builds up in the pressure chamber 22. Because of this required function and other criterian required in the operation of this valve and, in order to provide for a sharp edge orifice passage to control oil flow uniformly regardless of oil viscosity, the valve disc is made relatively thin. By way of an example, in a particular application, the valve disc 40′ was 0.008 in. thick and its normal height, including its thickness, was 0.022 to 0.024 in.. In this application, the diameter of the orifice 41′ in the valve disc 40′ was 0.055 in..

In such an application, during high speed engine operation, the pressure of oil in the pressure chamber 22 can reach, for example, approximately 3500 psi as the cylinder member 20 rides on the rise portion of the cam 5 and when the valve disc 40′ has been flexed into its flat position, not shown, whereby it is in seating engagement against the inner and outer valve seats 28 and 30, respectively, to block further flow communication from the pressure chamber 22 to the reservoir chamber 24 except for "leak-down" as previously described. Accordingly, in order to prevent further flexing and possible deformation of the thin, valve disc 40′ in such an application due to the high pressure oil acting against one side, the lower side with reference to FIG. 6, of the valve disc, there is provided in this preferred embodiment the support lands 83 which are suitably located intermediate the inner and outer valve seats 28 and 30, respectively, whereby to provide additional support to the then flat valve disc 40′ under such operating conditions.

Although two specific embodiments of hydraulic valve lifters constructed in accordance with the invention have been described and illustrated, it will be apparent to those skilled in the art that minor changes can be made in the construction and arrangement of the parts thereof without departing from the spirit and scope of the invention. For example, although the valve disc 40, in the embodiment shown in FIGS. 2 through 5, is of substantially circular configuration but with the cutouts or recessed notches 42 therein, it will be apparent that this valve disc could be of somewhat overall square shape but with the corners of the disc suitably rounded, as with a radius corresponding to the radius of the valve disc 40 shown, so that, in effect, in a plan view thereof it will have a configuration corresponding substantially to that of the lower end of the plunger member 21′ of the preferred embodiment, as seen in FIG. 7.

What we claim as new and desire to secure by Letters Patent of the United States is:

1. In a hydraulic valve lifter of the type including a cylinder member with a plunger slidable therein to define therewith a pressure chamber separated by an end wall of the plunger intermediate the ends thereof from a supply chamber in the plunger, the end wall having an apertured passage means extending axially therethrough and a spring to normally bias the plunger relative to the cylinder member in a direction to increase the effective length of the lifter, the improvement comprising an annular first valve seat means and an annular second valve seat means on said end wall radially inboard and outboard, respectively of said apertured passage means and extending toward said pressure chamber; a valve disc retainer slidably positioned in said plunger between said end wall and said spring which defines with said end wall of said plunger a variable volume valve chamber; said valve disc retainer having a central aperture therethrough; a thin plate flexible valve disc, with a central orifice passage therethrough movably located in said valve chamber for movement relative to said first valve seat means and said second valve seat means; said orifice passage and said central aperture defining a first passage means for flow communication between said supply chamber and said pressure chamber via said valve chamber and, second passage means operatively associated with said plunger to effect flow communication between said supply chamber and said pressure chamber via said valve chamber, said valve disc retainer being movable when fluid flows from the supply chamber to the pressure chamber due to a pressure difference of the fluid in these chambers, said valve disc is unseated relative to both said first and second valve seat means, and when fluid flows from the pressure chamber to the supply chamber via said first and second passage means a pressure differential will occur across said valve disc to effect movement thereof into seating engagement with said first valve seat means to block flow through said second passage means whereby the pressure differential across said valve disc can then be increased sufficiently whereby to effect flexing on said valve disc into seating engagement with also said first valve seat means thereby blocking flow through said first passage means to thereby trap the fluid in the pressure chamber so as to prevent movement of the plunger in a direction to shorten the effective length of the lifter.

2. In a hydraulic valve lifter of the type including a cylinder member with a plunger slidable therein to define therewith a pressure chamber separated by an end wall of the plunger from a supply chamber in the plunger, the end wall having an apertured passage means extending axially therethrough and, a spring to normally bias the plunger relative to the cylinder member in a direction to increase the effective length of the lifter, the improvement comprising an annular first valve seat means and an annular second valve seat means on said end wall radially inboard and outboard, respectively of said apertured passage means and extending toward said pressure chamber; a valve disc retainer slidably positioned in said plunger between said end wall and said spring to define with said end wall of said plunger a variable volume valve chamber; said valve disc retainer having a central aperture therethrough; a thin plate flexible valve disc, with a central orifice passage therethrough movably located in said valve chamber for movement relative to said first valve seat means and said second valve seat means; said orifice passage and said central aperture defining a first passage means for flow communication between said supply chamber and said pressure chamber via said valve chamber and, second passage means including axial extending passages defined by said valve disc retainer and the internal wall of said plunger beneath said end wall operatively associated with said plunger to effect flow communication between said supply chamber and said pressure chamber via said valve chamber, said valve disc retainer being movable when fluid flows from the supply chamber to the pressure chamber due to a pressure difference of the fluid in these chambers whereby said valve disc is unseated relative to both said first and second valve seat means so that fluid can flow freely via said second passage means to said pressure chamber, and when fluid flows from the pressure chamber to the supply chamber via said first and second passage means a pressure differential wall occur across said valve disc to effect movement thereof into seating engagement with said first valve seat means whereby to block flow through said second passage means so that the pressure differential across said valve disc will be rapidly increased to thereby effect flexing of said valve disc into a substantially flat configuration to effect its seating engagement with said first valve seat means thereby blocking flow through said first passage means to thereby trap the fluid in the pressure chamber so as to prevent movement of the plunger in a direction to shorten the effective length of the lifter.

3. In a hydraulic valve lifter of the type including a cylinder member with a plunger slidable therein to define therewith a pressure chamber separated by an intermediate end wall of the plunger from a supply chamber in the plunger, the end wall having an apertured passage means extending axially therethrough and, a spring operatively positioned in said cylinder member to normally bias the plunger relative to the cylinder member in a direction to increase the effective length of the lifter, the improvement comprising an annular first valve seat means and an annular second valve seat means on said end wall radially inboard and outboard, respectively of said apertured passage means and extending toward said pressure chamber adjacent one end of said plunger; a valve disc retainer slidably positioned in said plunger beneath said end wall to abut against one end of the spring and defining with said end wall of said plunger a variable volume valve chamber; said valve disc retainer having a central relatively large aperture therethrough; a thin plate flexible Belleville type valve disc of circular configuration movably located in said valve chamber for movement relative to said first valve seat means and said second valve seat means; an orifice passage of predetermined diameter through said valve disc substantially in the center thereof; said orifice passage and said central aperture defining a first passage means for flow communication between said supply chamber and said pressure chamber via said valve chamber; said one end of said plunger having flats on the exterior thereof whereby to define axial passages with the cylinder member opening into the pressure chamber and, radial ports in said plunger opening from said valve chamber into said axial passages and defining therewith second passage means for effecting flow communication between said supply chamber and said pressure chamber via said valve chamber, said valve disc retainer being movable away from said end wall against the bias of the spring when fluid flows from the supply chamber to the pressure chamber due to a pressure difference of the fluid in these chambers whereby said valve disc is unseated relative to both said first and second valve seat means so that fluid flows to said pressure chamber via both said first and second passage means, and when fluid flows from the pressure chamber toward the supply chamber via said first and second passage means a pressure differential will occur across said valve disc to effect movement thereof into seating engagement with said first valve seat means to block flow through said second passage means whereby the pressure differential across said valve disc can then be increased sufficiently whereby to effect flexing of said valve disc into a substantially flat configuration effecting its seating engagement with said first valve seat means to thereby also block flow through said first passage means whereby fluid is trapped in the pressure chamber to thus prevent further effective movement of the plunger in a direction shortening the effective length of the lifter.

4. A hydraulic valve lifter for use in an internal combustion engine and operative to vary the lift and timing of a cam actuated valve as a function of engine speed, said valve lifter including a cylinder member closed at one end; a hollow plunger slidably received in said cylinder member and having an end wall next adjacent to one end thereof to define a hydraulic supply chamber in said plunger on one side of said end wall which is adapted to be supplied with hydraulic fluid at a predetermined pressure, a valve disc retainer slidably received in said one end of said plunger below said end wall and being operative with said plunger to define with said one end of said cylinder member a pressure chamber filled with hydraulic fluid which when trapped therein prevents movement of said piston in a direction to shorten the effective axial length of said valve lifter; spring means operatively positioned to abut against said valve disc retainer to normally bias said valve disc retainer toward said end wall and operative to normally bias said plunger in a direction to increase the effective axial length of said valve lifter; said end wall of said plunger having an axial extending passage means therethrough offset radially of the reciprocating axis of said plunger; an annular first valve seat on said end wall extending toward said pressure chamber and located radially inward of said passage means; an annular second valve seat on said end wall located radially outward of said passage means in the same plane as said first valve seat; said valve disc retainer having a central aperture therethrough and an annular rim encircling said aperture and extending toward said end wall; said valve disc retainer defining with said end wall a variable volume valve chamber; a flexible cone shaped orifice disc valve with a central orifice therethrough of predetermined diameter to define with said central aperture a first passage means for effecting fluid communication via said valve chamber between said pressure chamber and said supply chamber, said valve disc being loosely positioned in said valve chamber and normally biased into seating engagement with said second valve seat by said spring means via said valve disc retainer, and a second passage means operatively associated with said one end of said plunger for effecting fluid communication via said valve chamber between said pressure chamber and said supply chamber with flow controlled by said valve disc, said valve disc being positioned so that fluid flow from said pressure chamber creates a fluid pressure differential across said valve disc that urges said valve disc to seat against said second valve seat and to block flow through said second passage means while permitting flow through said first passage means as controlled by said orifice, whereby said valve lifter is compressively yieldable up to a predetermined rate of compression at which the force of fluid flow from said pressure chamber is sufficient to bend said valve disc into a substantially flat configuration whereby to also effect its seating engagement against said first valve seat to block fluid flow from said pressure chamber to said supply chamber thus preventing further yielding until a reduction of the lifter load allows said valve disc to again return to its normal cone shape against the force of fluid pressure in said pressure chamber thereby allowing fluid communication between said supply chamber and said pressure chamber via both said first passage means and said second passage means.

* * * * *

UNITED STATES PATENT AND TRADEMARK OFFICE

CERTIFICATE OF CORRECTION

PATENT NO. : 4,223,648

DATED : September 23, 1980

INVENTOR(S) : Donald J. Pozniak; Ronald J. Herrin

It is certified that error appears in the above-identified patent and that said Letters Patent are hereby corrected as shown below:

Column 6, line 9, "value" should read -- valve --.

Column 7, line 11, "47" should read -- 47' --.

Column 9, line 52, "wall" should read -- will --.

Signed and Sealed this

*Seventeenth* Day of *February 1981*

[SEAL]

*Attest:*

RENE D. TEGTMEYER

*Attesting Officer*

*Acting Commissioner of Patents and Trademarks*